United States Patent [19]

Gobrecht

[11] 4,216,071

[45] Aug. 5, 1980

[54] ELECTRODEPOSITION CELL

[75] Inventor: Heinrich F. H. Gobrecht, Berlin, Fed. Rep. of Germany

[73] Assignee: Energietechnik GmbH Studiengesellschaft für Energie-Umwandlung-, -Fortleitung und -Anwendung, Kettwig, Fed. Rep. of Germany

[21] Appl. No.: 882,940

[22] Filed: Mar. 2, 1978

[30] Foreign Application Priority Data

Mar. 4, 1977 [DE] Fed. Rep. of Germany ..... 2709385

[51] Int. Cl.[2] ..... C25B 11/00; C25B 11/06

[52] U.S. Cl. ..... 204/242; 204/290 R; 204/290 F; 204/291; 204/292; 204/293; 204/294

[58] Field of Search ..... 204/45 A, 291-293, 204/294, 129, 242, 290 R, 290 F

[56] References Cited

U.S. PATENT DOCUMENTS

| | | | |
|---|---|---|---|
| 2,753,299 | 7/1956 | Ehrhardt | 204/45 A |
| 3,322,516 | 5/1967 | De Minser | 204/45 A |
| 4,011,149 | 3/1977 | Nozik | 204/129 |
| 4,094,751 | 6/1978 | Nozik | 204/129 |
| 4,124,464 | 11/1978 | Miyatani et al. | 204/129 |

FOREIGN PATENT DOCUMENTS

| | | |
|---|---|---|
| 1814576 | 11/1970 | Fed. Rep. of Germany . |
| 2328417 | 1/1974 | Fed. Rep. of Germany . |
| 2440010 | 3/1975 | Fed. Rep. of Germany . |
| 2626277 | 12/1976 | Fed. Rep. of Germany . |
| 1962860 | 11/1977 | Fed. Rep. of Germany . |

*Primary Examiner*—R. L. Andrews
*Attorney, Agent, or Firm*—Karl F. Ross

[57] ABSTRACT

An electrolytic cell for deposition of a material from an electrolyte comprises an anode and a cathode in contact with the electrolyte. At least one of these electrodes is at least partially provided with at least a surface coating of a semiconductor. Thus the anode is provided at least upon its surface in contact with the electrolyte with a p-type semiconductor while the cathode is provided at least on its surface in contact with the electrolyte with a n-type semiconductor. The semiconductor layers can have a thickness of 0.12 to 2 mm and can be covered with protective layers.

9 Claims, 3 Drawing Figures

ELECTRODEPOSITION CELL

FIELD OF THE INVENTION

The present invention relates to a method of and a device for carrying out electrodeposition and, more particularly, to an electrolytic deposition cell and method of operating same.

BACKGROUND OF THE INVENTION

Electrodeposition can be carried out with a device or system which comprises an anode and a cathode in contact with an electrolyte, and an electric current source connected across the anode and cathode to induce an ion migration in the electrolyte of ions of one charge to an electrode of the opposite charge. When the ions in the electrolyte come into contact with the electrode of the opposite charge, a charge neutralization occurs and a material from which the ions were constituted, can be transferred out of the electrolyte by a "deposition" whether this deposition results in electrodeposition or plating of the material onto the electrode in question, results in a release of the material as a gas, or otherwise effects a change in the state of the material. Hence the term "deposition" is used in its broadest possible sense to refer to the act of withdrawal from the electrolyte of a material which may have been present in a different form, i.e. as ions, in this electrode.

An electrolytic deposition itself generally comprises a vessel holding an electrolyte bath and an anode and cathode immersed in or in contact with the electrolyte. These electrodes are connected in a current-conducting path, usually making use of an external voltage source connected to the electrodes, to effect a separation of material from the electrolyte on one or both of the electrodes. As noted previously, the separated material can be a gas, a liquid or a solid.

While the electrolyte is usually a liquid, it can have any viscosity ranging from an extremely low viscosity to an extremely high viscosity as long as it sustains the iontransport phenomenon which results in the separation of material from the electrolyte in the manner previously described. For example, the electrolyte can be a gel which is practically nonflowable but is capable of sustaining the transport phenomenon.

The electrolytic separation cells are provided for a wide variety of approaches, purposes or processes. For example, they may be used for galvanization, i.e. electrocoating of a material upon a conductive substrata, for electrodeposition in the purification of metals, for electrolysis (gas generation) and for the production, recovery or purification of various chemical elements or substances.

The invention is concerned especially with electrochemical processes which take place at electrodes in contact with an electrolyte in electrolytic deposition cells. It is known that the combination of each electrode/electrolyte has a characteristic electrode potential as thermodynamically determined by the so-called Nernst equation. Further (see DETTNER-ELZE "HANDBUCH DER GALVANOTECHNIK, MüNCHEN", 1963, Vol. 1 Part 1, pp. 35 ff.).

Deviations from the electrode potential are dependent upon the current amplitude and are a result of kinetic barriers to a greater or lesser extent. These differences between the actual electrode potential and the theoretical electrode potential as determined by the Nernst equation are referred to as overpotential or overvoltage. The overvoltage depends upon various factors. One of these factors is the barrier to penetration by the current carrier through the HELMHOLTZ double layer at the boundary between the electrode and the electrolyte. The portion of the overvoltage which is a result of this penetration barrier can be referred to as penetration overvoltage. It depends upon the current density at the electrode and, in an as yet incompletely defined manner, upon the nature of the ions which are released from the electrolyte and upon the construction and material of the electrode in contact therewith.

It is known (see CHEMIE-INGENIEUR TECHNIK, 1966, Page 643 to 648) to provide electrodes for electrolysis which are composed of semiconductive materials. Investigations of this type are directed to determinations of the influence of the electronic structure of a solid body upon reactions taking place on its surface so as to clarify the nature of electrode surfaces and the phase boundaries between electrodes and electrolytes. Such investigations have, for example, studied the system selenium/sulfuric acid to determine the effect of the electrode surface upon the penetration overvoltage (see ZEITSCHRIFT FUR ELEKTROCHEMIE-BERICHTE DER BUNSENGESELLSCHAFT FÜR PHYSIKALISCHE CHEMIE, 1959, Pgs. 541-550). These investigations have indicated that the penetration overvoltage is a consequence of the reduced supply of current carriers with the electrode at the phase boundary.

It is also known that, in electrolytic deposition, the electrical energy used per mole of the deposited material is proportional to the applied voltage, the current flowing the system and the time. The penetration overvoltage increases the voltage necessary to pass a given current through this system and therefore causes an increase in the specific energy consumption, i.e. the energy comsumption per mole of deposited material.

OBJECT OF THE INVENTION

It is the principal object of the present invention to provide a method of and an apparatus for carrying out an electrolytic deposition process in which the specific energy consumption is reduced by comparison with earlier systems.

It is another object of the invention to provide an improved method of electrolytic deposition which can be effected at lower cost than earlier systems and with greater energy efficiency.

It is also an object of the invention to provide an electrolytic cell for carrying out the latter improved method.

SUMMARY OF THE INVENTION

The present invention is based upon my surprising discovery that, in electrolytic cells for the deposition of material from an electrolyte, the penetration overvoltage can be reduced or eliminated and thus the specific energy consumption (energy consumption per mole of deposited material) lowered significantly by providing the anode at least on its surface in contact with the electrolyte as a p-type semiconductors and/or the cathode at least on part of its surface in contact with the electrolyte of an n-type semiconductor.

The expressions "p-type semiconductor" and "n-type semiconductor" are intended to identify the semiconductive materials commonly known by these designations in the semiconductor field and in semiconductor physics generally. A p-type semiconductor, therefore, is a semiconducive material of positive conductivity type in which the conductivity carrier (current carrier) is a so-called defect electron or hole (mobile electron deficiency). An n-type semiconductor is one in which the electrical carrier is an electron. The semiconductors may be impurity-type semiconductors, intrinsic semiconductors or crystal-defect semiconductors. Any of the inorganic semiconductors known in the art can be used for the purposes of the present invention as long as the appropriate relationship between the conductivity type and the anode and cathode of the electrodeposition cell are observed. Apart from the semiconductors of the Examples, preferred p-type materials are Te, Sb, $BiSb-Te_3$, ZnSb and GeTe. Preferred n-type materials are Ge, Bi, $Bi_2Te_2Se$, InAs.

In general cuprous oxide, selenium, germanium and silicon semiconductive materials can be employed for all purposes with appropriate assignment of the materials by conductivity type of the anode and cathode of the electrolytic cell as defined above.

The invention is based upon the recommendation that an electrode formed with a semiconductor of the appropriate conductivity type at the face or phase boundary between the electrode and the electrolyte will generate improved mobility of the respective charge carrier (defect electrons or electrons) in a predetermined direction through the phase boundary between the electrode and the electrolyte and without having to overcome a significant potential barrier so that for these current carriers the penetration overvoltage is substantially reduced.

In accordance with the present invention, therefore, the defect electron penetration from the anodic semiconductor through the electrical double layer and into the electrolyte on the one hand and the penetration of electrons from the cathodic semiconduction through its electrical double layer to the electrolyte is facilitated. With respect to the deffect electrons it should be noted that the transfer of a defect electron from the p-type semiconductor to the electrolyte corresponds to a transfer of an electron from an ion of the electrolyte to the semiconductor, it being significant that the electron transition is to the valence band and not the conductivity band of the semiconductor.

The electrodes of the present invention can be composed of massive (solid) bodies of the semiconductive materials. However, for cost reasons it is advantageous to provide at least one of the electrodes as a substrate or carrier and the semiconductive component as a semiconductor layer upon this carrier. The semiconductive layer then should have a thickness of 0.02 to 2 mm, preferably 0.1 to 0.5 mm.

In this construction, moreover, the ohmic losses are relatively low since the support can be a high conductivity metal such as copper.

The semiconductor layer can be applied in various ways. For example, it can be applied by vapor deposition, cathodic sputtering or coating from a liquid phase. The doping of the semiconductor to establish the appropriate conductivity (p or n-type) can be effected prior to the application of the semiconductive layer or during the application of the semiconductive layer. It also may be accomplished subsequent to the application of the semiconductive layer, e.g. by diffusion. With respect to the carrier or support, it suffices that it be highly conductive and of sufficient structural stability to support the semiconductive layer and permit the semiconductive layer to be securely bonded to the support without the formation of a further barrier layer between the semiconductive material and the support.

Most advantageously, the support is composed of a metal while the semiconductive layer is an oxide or sulfide compound of the metal of the support. This construction has been found to be especially economical and desirable on physical grounds.

The semiconductive layer can thus by generated in situ upon the metallic support, by an appropriate treatment of the metallic body and the resulting layer can have a bond to the support which is especially good from the electrical and inorganic points of view.

The chemical treatment of the metallic carrier can initially result in formation of a stoichiometric compound which can be subjected to a subsequent treatment, for example, diffusion, reduction or oxidation, to establish the desired p or n-type of conductivity. Naturally, during the formation of the semiconductor, the oxygen or sulfur partial pressures can be controlled so that the semiconductor layer as it is formed will have the desired conductivity type.

According to another aspect of the invention, the support or carrier is composed of a ceramic and a conductor, in the form of at least one strip, is applied to the ceramic to act as an electrical contact with the same conductive layer. Depending upon requirements, more than one conductor can be provided upon the ceramic support. In this case the conductors are disposed between the support and semiconductor layer so that a surface of the conductor is turned toward the electrolyte and receives the semiconductive layer. Where the metal conductors are not coated with the semiconductive layer, the metal conductors are preferably coated with an insulating or protective layer so that they do not contact the electrolyte directly. The conductors can be applied galvanically or as a paste which can be applied to the ceramic by printed-circuit techniques and then fired to bond the metal conductor to the surface of the ceramic body.

It is possible that the p or n-type semiconductor which reduces the penetration overvoltage most effectively for a given purpose can not be used without protection because it may be electrolytically (anodically) solubilized or may be rendered ineffective by the diffusion of atoms of the electrolyte into the semiconductor. In this case, the invention provides that at least one of the semiconductive layers is provided with a protective layer of metal, a metal oxide, a semiconductor or an inorganic substance (e.g. lacquer) which is permeable to defect electrons and electrons but is resistant to the electrolyte and does not permit the penetration of ions and atoms of the electrolyte therethrough.

Protective metals for this purpose are extremely thin layers of platinum and gold while a suitable metal oxide is $Al_2O_3$. A suitable semiconductive material for the protective layer is CdO. The protective layer advantageously has a thickness of at most 3 microns and preferably is of no greater thickness than 1 micron. Protective layers of such thicknesses have been found not to detrimentally effect the efficiency of the semiconductive layers in reducing the penetration overvoltage. The protective layers can be applied by vapor deposition, cathodic sputtering or, in the case of organic substances, by dipping or spraying from a solution of the protective materials in a solvent.

The primary advantage and system of the present invention is that it provides an electrolyte deposition cell which can operate with a significantly reduced penetration overvoltage and thus has a reduced specific energy consumption. The electrodes are not of materially higher cost and do not introduce significant ohmic losses.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 1:
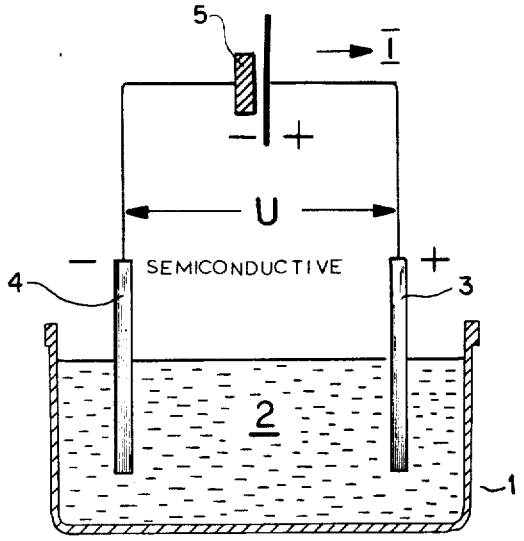
FIG. 1 is a schematic vertical cross-sectional view through an electrolytic deposition cell emboding the invention.

FIG. 1 shows a cell for the electrode deposition of a material from an electrolyte 2 in receptacle 1. A pair of electrodes 3 and 4, respectively an anode and a cathode, are immersed in the electrolyte 2 and are connected, respectively, to the positive and negative terminals of a direct-current source 5, e.g. a battery, applying a voltage U across the electrodes so that a current 1 flows in the electrodeposition current.

The anode 3 and/or the cathode 4 is provided, at least on its surface in contact with the electrolyte with a semiconductive material, e.g. a semiconductor layer. In the case of the anode 3 the semiconductor is a p-type semiconductor while, in the case of the cathode the semiconductor is an n-type conductor.

Figure 2:
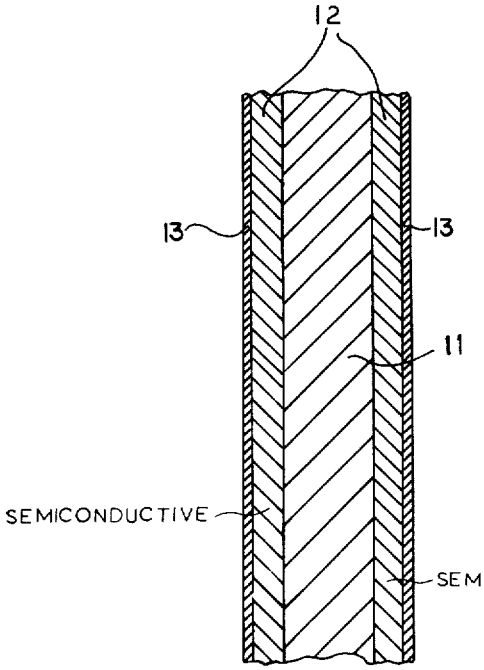
FIG. 2 is a section through an electrode of the cell of FIG. 1.

FIG. 2 shows, in section, an electrode which can be used in the system of FIG. 1 and which comprises a carrier 11 the opposite faces of which are provided with semiconductive layers 12 which will be p- or n-type semiconductors depending upon whether the electrode is to be used as the anode 3 or cathode 4. The support 11 is a conductive metal. The thickness of the semiconductor layers 12 ranges between 0.02 and 2 mm. While both surfaces of the support 11 are shown to be coated with semiconductive layers in FIG. 2, it will be understood that one surface only need be provided with a conductive layer if the electrode is to be disposed in single counterelectrode.

To protect the semiconductor layers 12 from the detrimental effects of the electrolyte, these semiconductor layers are provided with protective coatings 13 having a thickness of at least 3 microns and preferably up to 1 micron. The protective layers 13 may be composed of gold and have the effect of blocking the defect electrons and electrons while preventing the passage of ions and atoms while not significantly adversely effecting the semiconductor layers 12.

Figure 3:
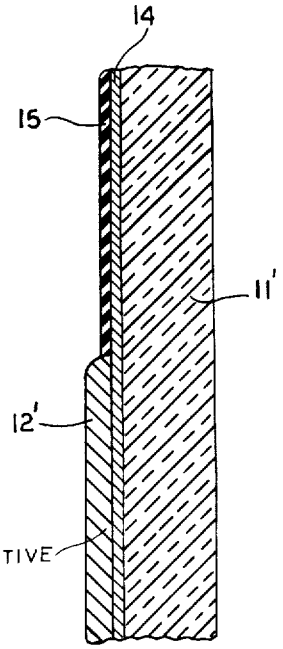
FIG. 3 is a section through an electrode according to the invention in another embodiment.

Another embodiment has been shown in FIG. 3 wherein the carrier 11' is composed of a ceramic, e.g. an oxide-type ceramic such as $Al_2O_3$. The ceramic body 11' is provided by printedcircuit techniques with a metal conductor strip or layer 14 to which is applied the semiconductor layer 12. The portions of the metal layer 14 which are not covered by the semiconductor 12' can be coated with a protective or insulating layer 15 to prevent deterioration of the metal strip in the electrolyte. Protective layers 13 can be applied to the semiconductor layers 12'.

SPECIFIC EXAMPLES

EXAMPLE I

The electrode material of the cathode consists of titanium which is oxidized along its surface to $TiO_2$ (rutile), the latter can be subjected to partial reduction in hydrogen to an oxygen content between $TiO_2$ and TiO, thereby transforming the rutile insulating structure into an n-type semiconductor whose active material is $Ti_2O_3$. This can result during the use of the electrode for the release of hydrogen from an aqueous electrolyte. In practice, the electrode can be used for a prolonged period before the oxidation becomes too pronounced and the electrode is rendered ineffective. Other suitable n-type semiconductors in this Example are titanium nitride, $Z_2O_3$, ZC and nitrogen-doped silicon carbide.

EXAMPLE II

Stoichiometric ZnO is an insulator which, by reduction, can be given good electrical conductivity. Sintered ZnO has high stability. A ZnO electrode is spray deposited on a rough-surface porcelain ceramic and subjected to a sintering process in hydrogen to form a single oxide layer of n-type conductivity which is used for a cathode in the release of hydrogen from an electrolytic cell.

EXAMPLE III

A thin layer of 0.1 to 2 mm thickness is applied to a metal or ceramic carrier of NiO which, in stoichiometric relationship of oxygen and nickel, is an insulating material. By development of oxygen on the surface of the electrode and the diffusion of nickel, holes or defect electrons are created ($\rho \sim 10$ ohm. cm). By doping with a monovalent material, namely, lithium, the specific resistance $\rho$ is reduced to about 1 ohm.cm. The p-conductivity anode is used in an electrolysis cell for the release of oxygen which does not reduce the effect of the electrode but rather improves it by increasing its conductivity.

EXAMPLE IV

The p-type semiconductor layer upon the anode is a copper oxide $Cu_2O$ which is either applied to or formed on a copper electrode or deposited upon a ceramic. When the copper oxide is formed in situ, it is produced by superficial oxidation of a copper layer. The copper oxide can also be provided in pulverulent form on the metal or ceramic carrier, the latter having been provided with metallic conductors to which the semiconductor is bonded. The absorption of further oxygen during use of the electrode increases the conductivity of this semiconductive layer.

EXAMPLE V

Trigonal selenium is used as the anodic semiconductor, the selenium layer being applied to a sand blast-roughened iron plate by vapor deposition. The selenium is transformed at a temperature of 160° to 180° C. from the amorphic to the trigonal phase by procedures known in the fabrication of rectifier plates. The conductivity is increased by doping the selenium with chlorine or bromine.

EXAMPLE VI

Silicon carbide doped with aluminum forms a semiconductor highly resistant to chemical attack.

EXAMPLE VII

Each of the semiconductive layers of Examples I through VI were coated with 0.01 micron in gold and platinum in separate tests as protective layers. The result was, in each case, an increase in the resistance of the semiconductive layer to chemical attack and an absence of severe reduction on the effect of the semiconductor in reducing the penetration over-voltage. The electrodes were all used effectively as cathodes and anodes in electrolytic cells for the release of oxygen and hydrogen by electrolysis.

I claim:

1. An electrolytic cell for the release of a substance from an electrolyte at an electrode, comprising means forming a bath of said electrolyte, and an anode and a cathode in contact with said electrolyte in said bath and connectable respectively with positive and negative terminals of a current source, said anode comprising a support provided upon its surface with a p-doped semiconductor layer having a thickness of 0.02 to 2 mm, said cathode consisting of a support and a surface layer of n-doped semiconductor the n-doped semiconductor layer of said cathode having a thickness of 0.02 to 2 mm.

2. The electrolytic cell defined in claim 1 wherein each of said semiconductor layers has a thickness of 0.1 to 0.5 mm.

3. The electrolytic cell defined in claim 2 wherein each of said supports is composed of a metal.

4. An electrolytic cell for the release of a substance from an electrolyte at an electrode, comprising an anode and a cathode in contact with an electrolyte and connectible respectively with positive and negative terminals of a current source, said anode and said cathode constituting electrodes, at least one of said electrodes being provided with at least a layer of a semiconductive material in regions of said one of said electrodes in contact with said electrolyte, said semiconductive material being a p-type semiconductor in the case of said anode and an n-type semiconductor in the case of said cathode, said one of said electrodes comprising a support, said semiconductive material being formed as a layer on said support with a thickness of 0.2 to 2 mm, said semiconductive layer being an oxide or sulfide of the metal of said support.

5. An electrolytic cell for the release of a substance from an electrolyte at an electrode, comprising an anode and a cathode in contact with an electrolyte and connectible respectively with positive and negative terminals of a current source, said anode and said cathode constituting electrodes, at least one of said electrodes being provided with at least a layer of a semiconductive material in regions of said one of said electrodes in contact with said electrolyte, said semiconductive material being a p-type semiconductor in the case of said anode and an n-type semiconductor in the case of said cathode, said one of said electrodes comprising a support, said semiconductive material being formed as a layer on said support with a thickness of 0.02 to 2 mm, said support being ceramic, the ceramic support being provided with a metallic conductor, said semiconductive layer being applied to said conductor.

6. An electrolytic cell for the release of a substance from an electrolyte at an electrode, comprising an anode and a cathode in contact with an electrolyte and connectible respectively with a positive and negative terminals of a current source, said anode and said cathode constituting electrodes, at least one of a semiconductive material in regions of said one of said electrodes in contact with said electrolyte, said semiconductive material being a p-type semiconductor in the case of said anode and an n-type semiconductor in the case of said cathode, said one of said electrodes comprising a support, said semiconductive material being formed as a layer on said support with a thickness of 0.02 to 2 mm, said cell further comprising a protective layer covering said semiconductive layer and permeable to defect electrons and electrons while being impermeable to ions and atoms, said protective layer being composed of metal, a metal carbide, a different semiconductor from that of said semiconductive material or a ceramic substance.

7. The electrolyte cell defined in claim 6 wherein said protective layer has a thickness of up to 3 microns.

8. The electrolytic cell defined in claim 7 wherein the thickness of said protective layer is no greater than 1 micron.

9. The electrolytic cell defined in claim 5 wherein a portion of said conductor is not covered by said semiconductive material, further comprising a protective coating on said portion of said conductor.

* * * * *